US009412302B2

(12) United States Patent
Yang

(10) Patent No.: US 9,412,302 B2
(45) Date of Patent: Aug. 9, 2016

(54) PIXEL DRIVING CIRCUIT, DRIVING METHOD, ARRAY SUBSTRATE AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventor: Shengji Yang, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 0 days.

(21) Appl. No.: 14/437,193

(22) PCT Filed: Sep. 3, 2014

(86) PCT No.: PCT/CN2014/085823

§ 371 (c)(1),
(2) Date: Apr. 20, 2015

(87) PCT Pub. No.: WO2015/169015

PCT Pub. Date: Nov. 12, 2015

(65) Prior Publication Data

US 2016/0140900 A1 May 19, 2016

(30) Foreign Application Priority Data

May 4, 2014 (CN) ..... 2014 1 0184466

(51) Int. Cl.
*G09G 3/32* (2016.01)

(52) U.S. Cl.
CPC ..... *G09G 3/3258* (2013.01); *G09G 2300/0439* (2013.01)

(58) Field of Classification Search
CPC ..... A01B 12/006; G09G 3/3258; G09G 2300/0439
See application file for complete search history.

(56) References Cited

U.S. PATENT DOCUMENTS

2006/0221028 A1 10/2006 Aoki
2008/0238327 A1 10/2008 Cho et al.

(Continued)

FOREIGN PATENT DOCUMENTS

CN 102708819 A 10/2012
CN 102737581 A 10/2012

(Continued)

OTHER PUBLICATIONS

International Search Report of the International Searching Authority with Notice of Transmittal of the International Search Report of PCT/CN2014/085823 in Chinese, mailed Feb. 4, 2015.

(Continued)

*Primary Examiner* — Charles Hicks
(74) *Attorney, Agent, or Firm* — Collard & Roe, P.C.

(57) ABSTRACT

A pixel driving circuit, comprises: a line (Data), a first scanning line (Scan1), a second scanning line (Scan2), an enabling control line (Em), a power supply line (S), a light emitting device (D), a driving transistor (DTFT), a storage capacitor (C), a resetting unit (1), a data writing unit (2) and a light emitting control unit (3), and further discloses a pixel driving method, an array substrate and a display apparatus. The pixel driving circuit of the present disclosure solves the problem of non-uniformity of the threshold voltage caused by the manufacturing process and long-time operation of the pixel point driving transistor by means of compensating, so that the current flowing through each pixel point light emitting device is not affected by the threshold voltage, thereby finally ensuring the uniformity of the image display.

20 Claims, 4 Drawing Sheets

(56) References Cited

U.S. PATENT DOCUMENTS

| | | | | |
|---|---|---|---|---|
| 2014/0118231 | A1 | 5/2014 | Yang et al. | |
| 2014/0146032 | A1 * | 5/2014 | Tsao | G09G 3/3648 345/212 |
| 2014/0175992 | A1 | 6/2014 | Yang | |

FOREIGN PATENT DOCUMENTS

| | | | |
|---|---|---|---|
| CN | 103000134 | A | 3/2013 |
| CN | 103021338 | A | 4/2013 |
| CN | 103345912 | A | 10/2013 |
| CN | 103531148 | A | 1/2014 |
| CN | 103971638 | A | 8/2014 |
| CN | 203812535 | U | 9/2014 |

OTHER PUBLICATIONS

Written Opinion of the International Searching Authority of PCT/CN2014/085823 in Chinese with English translation mailed Feb. 4, 2015.

* cited by examiner

PIXEL DRIVING CIRCUIT, DRIVING METHOD, ARRAY SUBSTRATE AND DISPLAY APPARATUS

CROSS REFERENCE TO RELATED APPLICATIONS

This application is the National Stage of PCT/CN2014/085823 filed on Sep. 3, 2014, which claims priority under 35 U.S.C. §119 of Chinese Application No. 201410184466.1 filed on May 4, 2014, the disclosure of which is incorporated by reference.

TECHNICAL FIELD

The present disclosure relates to a pixel driving circuit, a driving method, an array substrate and a display apparatus.

BACKGROUND

An organic light emitting display (AMOLED) is a hot topic in the present flat panel display research field. Compared with a liquid crystal display, the OLED has advantages of low power consumption, low production cost, self-luminescent, broad viewing angle, and fast response speed and so on. At present, in the display field of a mobile phone, a PDA and a digital camera and the like, OLED has started to replace a traditional LCD display screen. The pixel driving circuit design is a core technical content of the AMOLED display, and has important research significance.

Unlike a thin film transistor liquid crystal display (TFT-LCD) that utilizes a stable voltage to control luminance, OLED belongs to a current-driven display and needs a stable current to control light emitting.

SUMMARY

The technical problem to be solved by the present disclosure is how to keep the current flowing through OLED of each pixel consistent.

In order to solve the above technical problem, one aspect of the present disclosure provides a pixel driving circuit, comprising: a data line, a first scanning line, a second scanning line, an enabling control line, a power supply line, a light emitting device, a driving transistor, a storage capacitor, a resetting unit, a data writing unit and a light emitting control unit.

The resetting unit is connected to the enabling control line and a first terminal of the storage capacitor and configured to reset a voltage at the first terminal of the storage capacitor to low voltage under a control of the enabling control line.

The data writing unit is connected to a second terminal of the storage capacitor, the first scanning line and the driving transistor, and configured to write information including a threshold voltage of the driving transistor and a voltage of the data line into the second terminal of the storage capacitor under a control of the first scanning line.

The light emitting control unit is connected to the second scanning line, the data line, the power supply line, the first terminal of the storage capacitor, the driving transistor and the light emitting device. A gate of the driving transistor is connected to the second terminal of the storage capacitor, and a source and a drain thereof are connected to the light emitting control unit. The light emitting control unit is configured to make the first terminal of the storage capacitor be the voltage of the data line under a control of the second scanning line, make two terminals of the storage capacitor keep a voltage difference and make the driving transistor connected to the power supply line, so as to drive the light emitting device to emit light.

Alternatively, the resetting unit comprises a first transistor, whose gate is connected to the enabling control line, source is connected to the first terminal of the storage capacitor, and drain is connected to a ground. The first transistor is configured to make the first terminal of the storage capacitor connected to the ground under the control of the enabling control line, so as to set the first terminal of the storage capacitor to the low voltage.

Alternatively, the data writing unit comprises: a second transistor and a third transistor, wherein a gate of the second transistor is connected to the first scanning line, a source thereof is connected to the data line, and a drain thereof is connected to a source of the driving transistor; a gate of the third transistor is connected to the first scanning line, a source thereof is connected to a drain of the driving transistor, and a drain thereof is connected to the second terminal of the storage capacitor. The second transistor and the third transistor are configured to form an access under the control of the first scanning line, so as to write the information including the threshold voltage of the driving transistor and the voltage of the data line into the second terminal of the storage capacitor.

Alternatively, the light emitting control unit comprises: a fourth transistor, a fifth transistor and a sixth transistor, a gate of the fourth transistor is connected to the second scanning line, a source thereof is connected to the power supply line, and a drain thereof is connected to the source of the driving transistor; a gate of the fifth transistor is connected to the second scanning line, a source thereof is connected to the drain of the driving transistor, and a drain thereof is connected to the light emitting device; a gate of the sixth transistor is connected to the second scanning line, a source thereof is connected to the data line, and a drain thereof is connected o the first terminal of the storage capacitor. The sixth transistor is configured to write the voltage of the data line into the first terminal of the storage capacitor under the control of the second scanning line and make the two terminals of the storage capacitor keep the voltage difference. The fourth transistor and the fifth transistor are configured to form an access under the control of the second scanning line, so that the driving transistor is connected to the power supply line, so as to drive the light emitting device to emit light.

Alternatively, the light emitting device is an organic light emitting diode, whose anode is connected to the light emitting control unit and cathode is connected to the ground.

Another aspect of the present disclosure further provides a driving method of the pixel driving circuit described above, comprising following steps: applying an enable signal to the enabling control line, so that the resetting unit resets the first terminal of the storage capacitor to the low voltage; applying a first scanning effective signal to the first scanning line so that the data writing unit writes the information including the threshold voltage of the driving transistor and the voltage of the data line into the second terminal of the storage capacitor; and applying a second scanning effective signal to the second scanning line so that the light emitting control unit writes the voltage of the data line into the first terminal of the storage capacitor, makes the two terminals of the storage capacitor keep a voltage difference and makes the driving transistor connected to the power supply line so as to drive the light emitting device to emit light.

Alternatively, the step of applying a first scanning effective signal to the first scanning line so that the data writing unit writes the information including the threshold voltage of the driving transistor and the voltage of the data line into the second terminal of the storage capacitor comprises:

applying the first scanning effective signal to the first scanning line so that the second transistor and the third transistor are turned on to form an access, so as to write the information including the threshold voltage of the driving transistor and the voltage of the data line into the second terminal of the storage capacitor.

Alternatively, the step of applying a second scanning effective signal to the second scanning line so that the light emitting control unit writes the voltage of the data line into the first terminal of the storage capacitor, makes the two terminals of the storage capacitor keep a voltage difference and makes the driving transistor connected to the power supply line so as to drive the light emitting device to emit light comprises:

applying the second scanning effective signal to the second scanning line so that the sixth transistor is turned on to write the data voltage into the first terminal of the storage capacitor and make the two terminals of the storage capacitor keep a voltage difference and the fourth transistor and the fifth transistor are turned on to form an access, so that the driving transistor is connected to the power supply line, so as to drive the light emitting to emit light.

Another aspect of the present disclosure further provides an array substrate comprising the pixel driving circuit described above.

Another aspect of the present disclosure further provides a display apparatus comprising the array substrate described above.

In the pixel driving circuit and driving method thereof according to the embodiments of the present disclosure, the data writing unit writes the information of the threshold voltage of the driving transistor and the voltage of the data line into the storage capacitor. When the light emitting control unit controls light emitting, the information of the threshold voltage of the driving transistor written into the storage capacitor compensate for the threshold voltage of the driving transistor when the driving transistor emits light, which solves the problem of non-uniformity of the threshold voltage caused by the manufacturing process and long-time operation of the pixel point driving transistor, so that the current flowing through each pixel point light emitting device is not affected by the threshold voltage, thereby finally ensuring the uniformity of the image display.

DETAILED DESCRIPTION

Specific implementations of the present disclosure will be further described in detail by combining with accompanying figures and embodiments.

Figure 1:
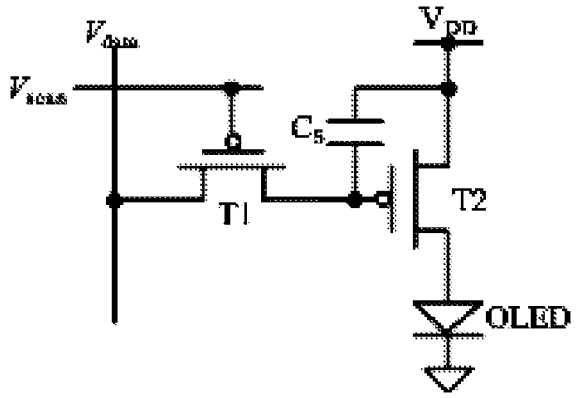
FIG. 1 is a schematic diagram of a structure of a known 2T1C pixel driving circuit.

FIG. 1 is a known 2T1C pixel driving circuit. This circuit is constituted of only one driving TFT, one switch TFT and one storage capacitor Cs. When a scanning line selects one row, $V_{scan}$ is low, T1 is turned on, and a data voltage $V_{data}$ is written into the storage capacitor Cs. After the scanning of this row ends, $V_{scan}$ becomes high, T1 is turned off, and a gate voltage stored on the Cs drives a T2 transistor, so that the T2 transistor generates current to drive OLED, thereby ensuring OLED to continuously emit light within one frame. The saturation current formula of TFT is $I_{OLED}=K(V_{GS}-V_{th})^2$. Due to process manufacturing and device aging and so on, the threshold voltage ($V_{th}$) of the driving TFT of respective pixel points will drift, which results in that the current flowing through OLED of each pixel point changes due to the change of $V_{th}$, thereby influencing the display effect of the entire image.

Figure 2:
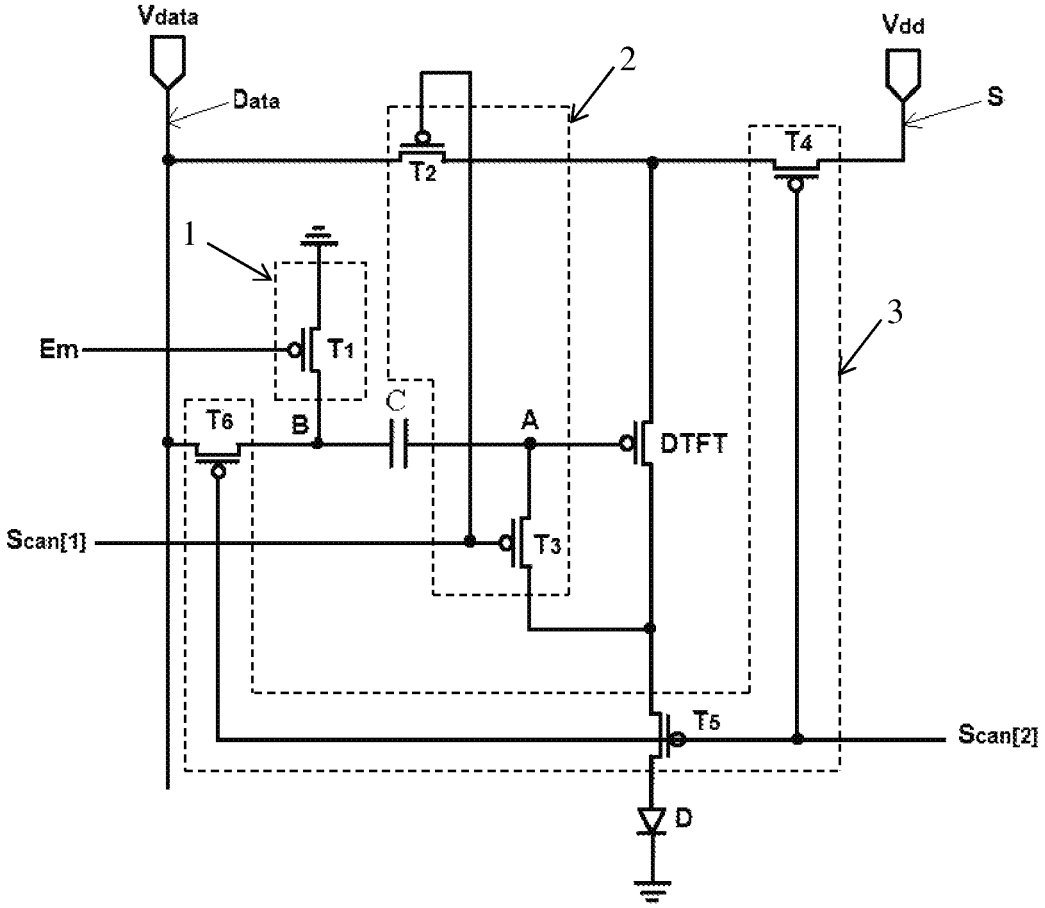
FIG. 2 is a schematic diagram of a structure of a pixel driving circuit of an embodiment of the present disclosure.

FIG. 2 shows a circuit structure of a pixel driving circuit of the embodiment. As shown in FIG. 2, the circuit comprises: a data line Data, a first scanning line Scan[1], a second scanning line Scan[2], an enabling control line Em, a power supply line S, a light emitting device D, a driving transistor DTFT, a storage capacitor C, a resetting unit 1, a data writing unit 2 and a light emitting control unit 3.

The resetting unit 1 is connected to the enabling control line Em and a first terminal (i.e., node B) of the storage capacitor C, and is configured to reset a voltage at the first terminal of the storage capacitor C to a low voltage under a control of the enabling control line Em.

The data writing unit 2 is connected to a second terminal (node A) of the storage capacitor C, the first scanning line Scan[1], and the driving transistor DTFT, and is configured to write information including a threshold voltage $V_{th}$ of the driving transistor DTFT and a voltage $V_{data}$ of the data line Data into the second terminal of the storage capacitor C under a control of the first scanning line Scan[1]. At this time, the voltage at node A is $V_{data}-V_{th}$.

The light emitting control unit 3 is connected to the second scanning line Scan[2], the data line Data, the power supply S, the first terminal of the storage capacitor C, the driving transistor DTFT and the light emitting device D. A gate of the driving transistor DTFT is connected to the second terminal of the storage capacitor C, and a source and a drain thereof are connected to the light emitting control unit 3. The light emitting control unit 3 is configured to make the first terminal of the storage capacitor C be the voltage $V_{data}$ of the data line Data under a control of the second scanning line Scan[2], make two terminals of the storage capacitor C keep a voltage difference, and make the driving transistor DTFT connected to the power supply line S, so as to drive the light emitting device D to emit light.

In the pixel driving circuit of the present embodiment, the data writing unit 2 writes the information of the threshold voltage of the driving transistor and the voltage of the data line into the storage capacitor C. When the light emitting control unit 3 controls light emitting, the information of the threshold voltage of the driving transistor written into the storage capacitor C compensates for the threshold voltage of the driving transistor when the driving transistor emits light, which solves the problem of non-uniformity of the threshold voltage caused by the manufacturing process and long-time operation of the pixel point driving transistor, so that the current flowing through each pixel point light emitting device is not affected by the threshold voltage, thereby finally ensuring the uniformity of the image display.

In the present embodiment, the resetting unit 1 comprises: a first transistor T1. A gate of the first transistor T1 is connected to the enabling control line Em, a source thereof is connected to the first terminal of the storage capacitor C, and a drain thereof is connected to a ground. The first transistor T1 is configured to make the first terminal of the storage capacitor C connected to the ground under the control of the enabling control line Em, so as to set the first terminal of the storage capacitor C to the low voltage. That is, when Em is an active signal, the first terminal of C is connected to the ground by T1, and the voltage at node B is 0.

In the present embodiment, the data writing unit 2 comprises: a second transistor T2 and a third transistor T3. A gate of the second transistor T2 is connected to the first scanning line Scan[1], a source thereof is connected to the data line Data, and a drain thereof is connected to the source of the driving transistor DTFT. A gate of the third transistor T3 is connected to the first scanning line Scan[1], a source thereof is connected to the drain of the driving transistor DTFT, and a drain thereof is connected to the second terminal of the storage capacitor C. The second transistor and the third transistor are configured to form an access under the control of the first scanning line Scan[1], so as to write the information including the threshold voltage of the driving transistor DTFT and the voltage of the data line into the second terminal of the storage capacitor C.

For example, as shown in FIG. 2, when the first scanning line Scan[1] is effective, T2 and T3 are turned on, so as to form an access T2→DTFT→T3, and the $V_{data}$ signal starts to charge the node A through the access T2→DTFT→T3 until the node A is charged to be $V_{data}-V_{th}$ (which satisfies that a voltage difference between the gate and the source of DTFT is $V_{th}$). At this time, the voltage at the two terminals of the storage capacitor C is also $V_{data}-V_{th}$. In addition, since T5 is turned off, current in the access T2→DTFT→T3 will not flow through the light emitting device, which indirectly reduces the loss of service time of the light emitting device.

In the present embodiment, the light emitting control unit 3 comprises: a fourth transistor T4, a fifth transistor T5 and a sixth transistor T6. A gate of the fourth transistor T4 is connected to the second scanning line Scan[2], a source thereof is connected o the power supply line S, and a drain thereof is connected to the source of the driving transistor DTFT. A gate of the fifth transistor T5 is connected to the second scanning line Scan[2], a source thereof is connected the drain of the driving transistor DTFT, and a drain thereof is connected to the light emitting device D. A gate of the sixth transistor T6 is connected to the second scanning line Scan[2], a source thereof is connected to the data line Data, and a drain thereof is connected to the first terminal of the storage capacitor C. The sixth transistor T6 is configured to write the voltage of the data line into the first terminal of the storage capacitor C under the control of the second scanning line Scan[2] and make the two terminals of the storage capacitor C keep a voltage difference. The fourth transistor T4 and the fifth transistor T5 are configured to form an access under the control of the second scanning line Scan[2], so that the driving transistor DTFT is connected to the power supply lime S, so as to drive the light emitting device D to emit light.

As shown in FIG. 2, the light emitting control unit 3 comprises: a fourth transistor T4, a fifth transistor T5 and a sixth transistor T6. A gate of the fourth transistor T4 is connected to the second scanning line Scan[2], a source thereof is connected o the power supply line S, and a drain thereof is connected to the source of the driving transistor DTFT. A gate of the fifth transistor T5 is connected to the second scanning line Scan[2], a source thereof is connected to the drain of the driving transistor DTFT, and a drain thereof is connected to the light emitting device D. A gate of the sixth transistor T6 is connected to the second scanning line Scan[2], a source thereof is connected to the data line Data, and a drain thereof is connected to the first terminal of the storage capacitor C. When the second scanning line Scan[2] is effective, T4, T5 and T6 are turned on. At this time, the voltage at node B changes from the original 0V into $V_{data}$, while the node A is in a floating state. Therefore, in order to maintain the original voltage difference ($V_{data}-V_{th}$) between the nodes A and B, a constant voltage jump will occur to the voltage at the node A of the gate of the DTFT, and the voltage at the node A jumps to $2V_{data}-V_{th}$. Moreover, at this time, T4, the driving transistor DTFT and T5 form an access T4→DTFT→T5, the source of the driving transistor DTFT is connected to the power supply line S, the voltage is $V_{dd}$, and current flows through the access T4→DTFT→T5, so that the light emitting device D starts to emit light.

It can be obtained from the saturation formula of the driving transistor DTFT the following:

$$I_D = K(V_{GS} - V_{th})^2 = K[V_{dd} - (2V_{data} - V_{th}) - V_{th}]^2 = K(V_{dd} - 2V_{data})^2$$

$$K = \mu \cdot C_{ox}\frac{W}{L}$$

Herein, $V_{GS}$ is a gate-source voltage of DTFT, μ is a carrier mobility, $C_{ox}$ is a gate oxide layer capacitor, and W/L is a width-length ratio of the driving transistor.

It can be seen from the above formula that the operation current $I_D$ has been not affected by $V_{th}$, but is only related with $V_{data}$, which solves thoroughly the problem of the threshold voltage ($V_{th}$) drift caused by the manufacturing process and long-time operation of the driving transistor DTFT, thereby eliminating its influence on the current $I_D$ that drives the light emitting device and ensuring normal operation of the light emitting device.

The light emitting device D in the present embodiment can be an organic light emitting diode (OLED), whose anode is connected to the light emitting control unit, and connected to the drain of the fifth transistor T5 in the example of FIG. 2, and cathode is connected to the ground.

The pixel driving circuit of the present embodiment overcomes the influence caused by the change of the threshold voltage $V_{th}$ of the driving transistor by means of compensating mode. At the same time, this design guarantees that no current flows through the light emitting device (OLED) when the circuit is in the compensating phase and buffering phase, and also indirectly increases the service time of the OLED.

There further provides in an embodiment of the present disclosure a driving method of the pixel driving circuit described above, comprising following steps:

applying an enable signal to the enabling control line Em, so that the resetting unit 1 resets the first terminal of the storage capacitor C to the low voltage;

applying a first scanning effective signal to the first scanning line Scan[1] so that the data writing unit 2 writes the information including the threshold voltage of the driving transistor DTFT and the voltage of the data line into the second terminal of the storage capacitor C; and applying a second scanning effective signal to the second scanning line Scan[2] so that the light emitting control unit 3 writes the voltage of the data line into the first terminal of the storage capacitor C, makes the two terminals of the storage capacitor C keep a voltage difference and makes the driving transistor DTFT connected to the power supply line so as to drive the light emitting device D to emit light.

In an exemplary embodiment, the step of applying a first scanning effective signal to the first scanning line Scan[1] so that the data writing unit 2 writes the information including the threshold voltage of the driving transistor DTFT and the voltage of the data line into the second terminal of the storage capacitor C may comprise:

applying the first scanning effective signal to the first scanning line Scan[1] so that the second transistor T2 and the third transistor T3 are turned on to form an access, so as to write the information including the threshold voltage of the driving transistor DTFT and the voltage of the data line into the second terminal of the storage capacitor C.

In an exemplary embodiment, the step of applying a second scanning effective signal to the second scanning line Scan[2] so that the light emitting control unit 3 writes the voltage of the data line into the first terminal of the storage capacitor C, makes the two terminals of the storage capacitor C keep a voltage difference and makes the driving transistor DTFT connected to the power supply line so as to drive the light emitting device D to emit light may comprise:

applying the second scanning effective signal to the second scanning line Scan[2] so that the sixth transistor T6 is turned on to write the voltage of the data line into the first terminal of the storage capacitor C and make the two terminals of the storage capacitor C keep a voltage difference, and the fourth transistor T4 and the fifth transistor T5 are turned on to form an access, so that the driving transistor DTFT is connected to the power supply line S, so as to drive the light emitting D to emit light.

The above driving method will be described below in detail by taking all the transistors in the pixel driving circuit in FIG. 2 being P-type transistors and the light emitting device being OLED as an example. The driving method includes three phases.

Figure 3:
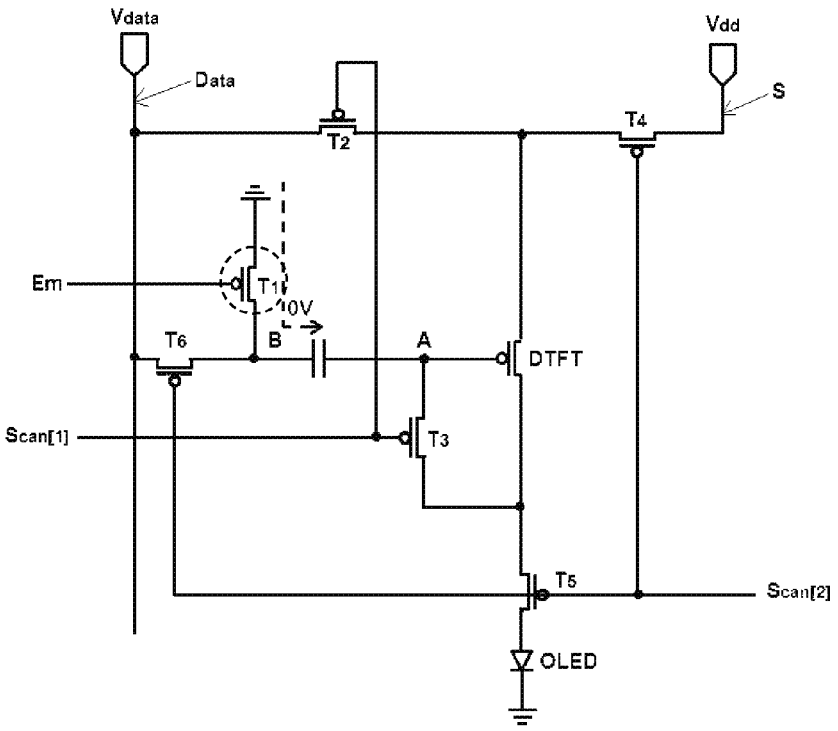
FIG. 3 is a schematic diagram of operation of the pixel driving circuit in FIG. 2 in a resetting phase.
Figure 4:
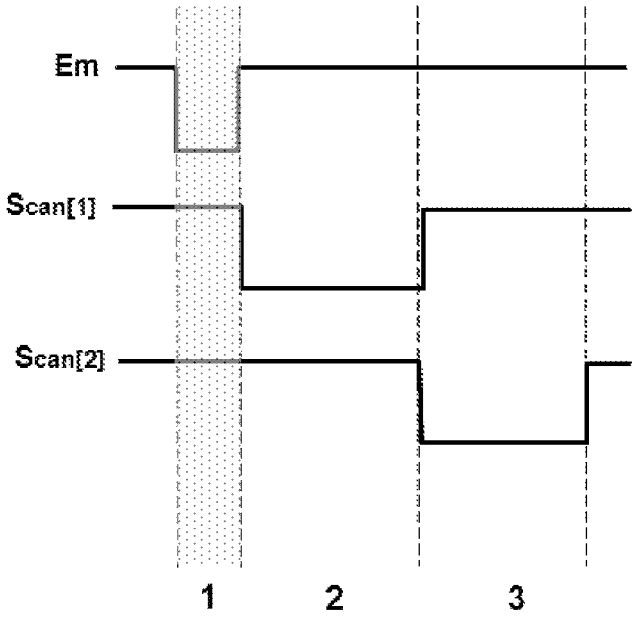
FIG. 4 is a timing diagram of the pixel driving circuit in FIG. 2 in a resetting phase, corresponding to a timing phase 1.

FIG. 3 schematically shows an equivalent circuit of the pixel driving circuit in FIG. 2 operating in a resetting phase. FIG. 4 shows a timing diagram of the pixel driving circuit in the resetting phase, corresponding to a timing phase 1. As shown in FIGS. 3 and 4, the timing diagram phase 1 is the resetting phase. At this time, Em is valid, T1 is turned on (as shown in the dashed line block in FIG. 3), and T2, T3, T4, T5 and T6 are turned off. This process resets the node B to be connected to the ground, that is, the first terminal of the storage capacitor C is connected to the ground (the current access of the first terminal of the storage capacitor C and the ground is as shown in the dotted arrow in FIG. 3). The voltage is 0V, and the previous voltage signal is reset.

Figure 5:
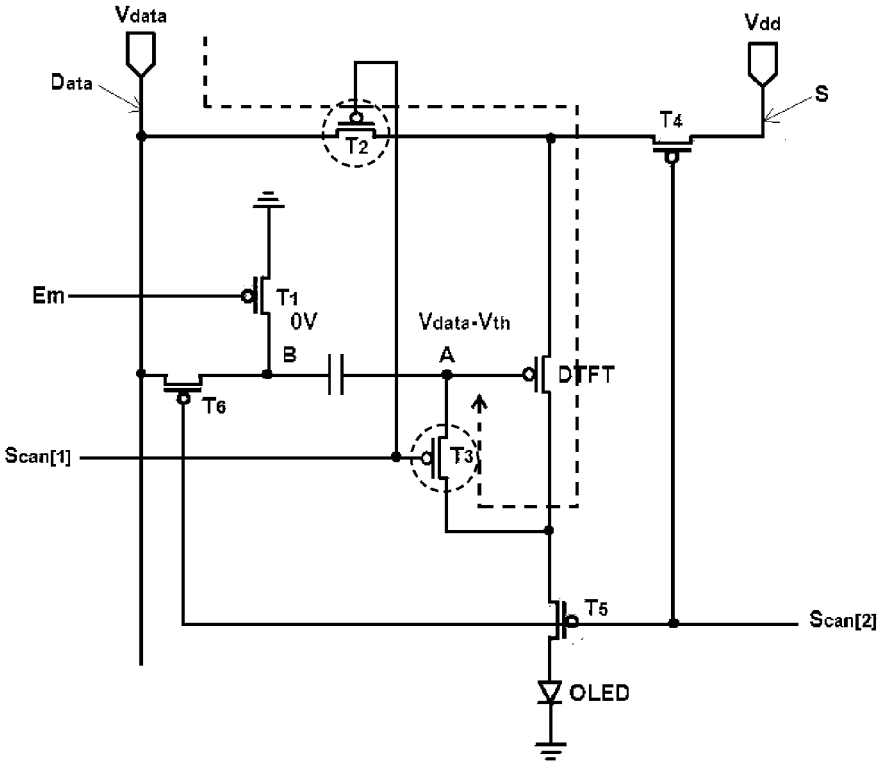
FIG. 5 is a schematic diagram of operation of the pixel driving circuit in FIG. 2 in a charging phase.
Figure 6:
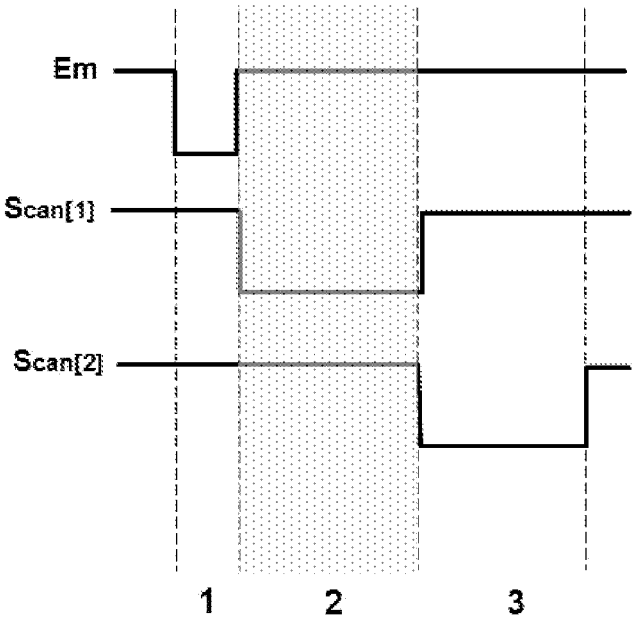
FIG. 6 is a timing diagram of the pixel driving circuit in FIG. 2 in a charging phase, corresponding to a timing phase 2.

FIG. 5 schematically shows an equivalent circuit of the pixel driving circuit in FIG. 2 operating in a charging phase, corresponding to a timing phase 2. As shown in FIGS. 5 and 6, the timing phase 2 is the charging phase. At this time, T2 and T3 are turned on (as shown in the dashed line block in FIG. 5), and T1, T4, T5, and T6 are turned off. The $V_{data}$ signal of the data line Data starts to charge the node A through the current access T2→DTFT→T3 (as shown in the dotted arrow in FIG. 5) until the node A is charged to be $V_{data}-V_{th}$ (which satisfies the voltage difference between the gate and source of DTFT is $V_{th}$). In this process, since the node B is connected to the ground and its potential is always 0, the voltage at the node A will be always maintained at $V_{data}-V_{th}$ after the charging is finished. In addition, since T5 is turned off, the current will not flow through OLED, thereby reducing indirectly the loss of the service time of OLED.

Figure 7:
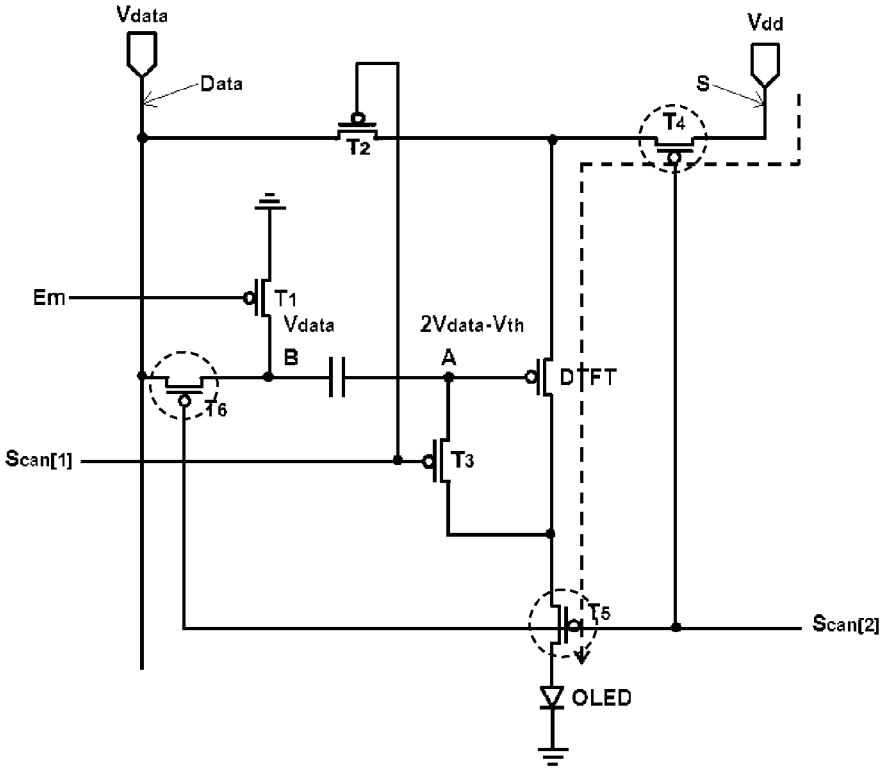
FIG. 7 is a schematic diagram of the pixel driving circuit in FIG. 2 in a compensating and light emitting phase.
Figure 8:
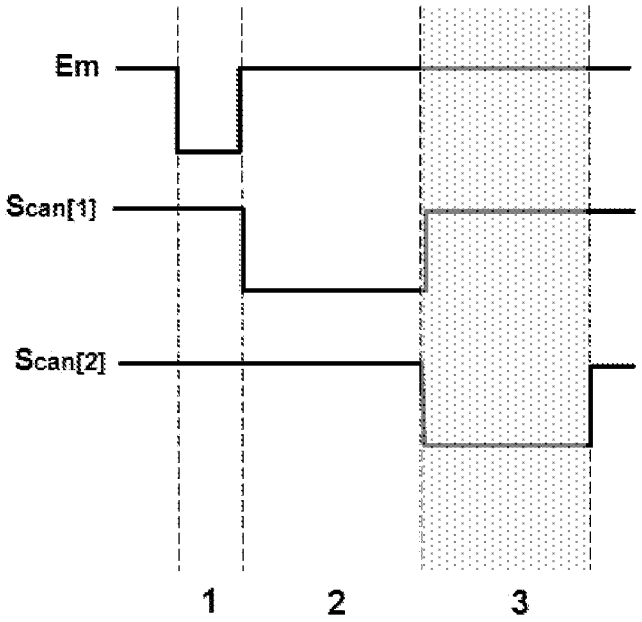
FIG. 8 is a timing diagram of the pixel driving circuit in FIG. 2 in the compensating and light emitting phase, corresponding to a timing phase 3.

FIG. 7 schematically shows an equivalent circuit of the pixel driving circuit in FIG. 2 in a compensating and light emitting phase. FIG. 8 schematically shows a timing diagram of the pixel driving circuit in FIG. 2 in the compensating and light emitting phase, corresponding to a timing phase 3. As shown in FIGS. 7 and 8, the timing phase 3 is the compensating and light emitting phase of the OLED pixel driving circuit. At this time, T4, T5 and T6 are turned on (as shown in the dashed line block in FIG. 7), and T2, T3, and T1 are turned off. At this time, the voltage at the node B changes from the original 0V into $V_{data}$, while the node A is in a floating state. Therefore, in order to maintain the original voltage difference ($V_{data}-V_{th}$) between the nodes A and B, a constant voltage jump will occur to the voltage at the node A of the gate of the DTFT, and the voltage at the node A jumps to $2V_{data}-V_{th}$. At this time, T4, the driving transistor DTFT and T5 form an access T4→DTFT→T5 (as shown in the dotted arrow in FIG. 7), the source of the driving transistor DTFT is connected to the power supply line S, and the voltage connected to the power supply line is $V_{dd}$, and current flows through the access T4→DTFT→T5, so that the light emitting device D starts to emit light.

It can be obtained from the saturation formula of the driving transistor DTFT the following:

$$I_D = K(V_{GS} - V_{th})^2 = K[V_{dd} - (2V_{data} - V_{th}) - V_{th}]^2 = K(V_{dd} - 2V_{data})^2$$

$$K = \mu \cdot C_{ox}\frac{W}{L}$$

Herein, $V_{GS}$ is a gate-source voltage of DTFT, μ is a carrier mobility, $C_{ox}$ is a gate oxide layer capacitor, and W/L is a width-length ratio of the driving transistor.

It can be seen from the above formula that $V_{th}$ in the final expression of the operation current $I_{OLED}$ has been offset at this time. That is, in the phase 2, the voltage at the node A will be always maintained at $V_{data}-V_{th}$, wherein $V_{th}$ compensates for the $V_{th}$ produced by the DTFT in the phase 3, so that $I_{OLED}$ is not affected by $V_{th}$, but is only related with $V_{data}$. Therefore, the problem of the threshold voltage ($V_{th}$) drift caused by the manufacturing process and long-time operation of the driving transistor DTFT is thoroughly solved, its influence on $I_{OLED}$ is eliminated and normal operation of the light emitting device is ensured.

Another embodiment of the present disclosure further provides an array substrate comprising the pixel driving circuit described above.

There further provides in another embodiment of the present disclosure a display apparatus comprising the above array substrate. This display apparatus can be any product or means having a display function, such as an AOLED panel, a TV set, a digital photo frame, a mobile phone, a tablet computer and so on.

The above implementations are just used for describing the present disclosure, but not used for limiting the present disclosure. Those skilled in the art can make various improvements and modifications without departing from the spirit and scope of the present disclosure, and thus these improvements and modifications as well as equivalent technical solutions also belong to the scope of the present disclosure. The patent protection scope of the present disclosure shall be defined by the Claims.

The present application claims the priority of a Chinese patent application No. 201410184466.1 filed on May 4, 2015. Herein, the content disclosed by the Chinese patent application is incorporated in full by reference as a part of the present disclosure.

What is claimed is:

1. A pixel driving circuit, comprising: a data line, a first scanning line, a second scanning line, an enabling control line, a power supply line, a light emitting device, a driving transistor, a storage capacitor, a resetting unit, a data writing unit and a light emitting control unit, wherein the resetting unit is connected to the enabling control line and a first terminal of the storage capacitor, and configured to reset a voltage at the first terminal of the storage capacitor to a low voltage under a control of the enabling control line;

the data writing unit is connected to a second terminal of the storage capacitor, the first scanning line and the driving transistor, and configured to write information including a threshold voltage of the driving transistor and a voltage of the data line into the second terminal of the storage capacitor under a control of the first scanning line; and the light emitting control unit is connected to the second scanning line, the data line, the power supply line, the first terminal of the storage capacitor, the driving transistor and the light emitting device, a gate of the driving transistor connected to the second terminal of the storage capacitor, and a source and a drain thereof connected to the light emitting control unit, and the light emitting control unit configured to make the first terminal of the storage capacitor be the voltage of the data line under a control of the second scanning line, make two terminals of the storage capacitor keep a voltage difference and make the driving transistor connected to the power supply line, so as to drive the light emitting device to emit light.

2. The pixel driving circuit according to claim 1, wherein the resetting unit comprises a first transistor, whose gate is connected to the enabling control line, source is connected to the first terminal of the storage capacitor, and drain is connected to a ground; and the first transistor is configured to make the first terminal of the storage capacitor connected to the ground under the control of the enabling control line, so as to set the first terminal of the storage capacitor to a low voltage.

3. The pixel driving circuit according to claim 2, wherein the data writing unit comprises: a second transistor and a third transistor, wherein a gate of the second transistor is connected to the first scanning line, a source thereof is connected to the data line, and a drain thereof is connected to a source of the driving transistor; a gate of the third transistor is connected to the first scanning line, a source thereof is connected to a drain of the driving transistor, and a drain thereof is connected to the second terminal of the storage capacitor; and the second transistor and the third transistor are configured to form an access under the control of the first scanning line, so as to write the information including the threshold voltage of the driving transistor and the voltage of the data line into the second terminal of the storage capacitor.

4. The pixel driving circuit according to claim 3, wherein the light emitting control unit comprises: a fourth transistor, a fifth transistor and a sixth transistor; a gate of the fourth transistor is connected to the second scanning line, a source thereof is connected to the power supply line, and a drain thereof is connected to the source of the driving transistor; a gate of the fifth transistor is connected to the second scanning line, a source thereof is connected to the drain of the driving transistor, and a drain thereof is connected to the light emitting device; a gate of the sixth transistor is connected to the second scanning line, a source thereof is connected to the data line, and a drain thereof is connected o the first terminal of the storage capacitor; the sixth transistor is configured to write the voltage of the data line into the first terminal of the storage capacitor under the control of the second scanning line and make the two terminals of the storage capacitor keep a voltage difference, and the fourth transistor and the fifth transistor are configured to form an access under the control of the second scanning line, so that the driving transistor is connected to the power supply, so as to drive the light emitting device to emit light.

5. The pixel driving circuit according to claim 1, wherein the light emitting device is an organic light emitting diode, whose anode is connected to the light emitting control unit and cathode is connected to the ground.

6. A driving method of the pixel driving circuit according to claim 1 comprising following steps:

applying an enable signal to the enabling control line so that the resetting unit resets the first terminal of the storage capacitor to a low voltage;

applying a first scanning effective signal to the first scanning line so that the data writing unit writes the information including the threshold voltage of the driving transistor and the voltage of the data line into the second terminal of the storage capacitor; and applying a second scanning effective signal to the second scanning line so that the light emitting control unit writes the voltage of the data line into the first terminal of the storage capacitor, makes the two terminals of the storage capacitor keep a voltage difference and makes the driving transistor connected to the power supply line so as to drive the light emitting device to emit light.

7. The driving method according to claim 6, wherein the step of applying a first scanning effective signal to the first scanning line so that the data writing unit writes the information including the threshold voltage of the driving transistor and the voltage of the data line into the second terminal of the storage capacitor comprises:

applying the first scanning effective signal to the first scanning line so that the second transistor and the third transistor are turned on to form an access, so as to write the information including the threshold voltage of the driving transistor and the voltage of the data line into the second terminal of the storage capacitor.

8. The driving method according to claim 6, wherein the step of applying a second scanning effective signal to the second scanning line so that the light emitting control unit writes the voltage of the data line into the first terminal of the storage capacitor, makes the two terminals of the storage capacitor keep a voltage difference and makes the driving transistor connected to the power supply line so as to drive the light emitting device to emit light comprises:

applying the second scanning effective signal to the second scanning line so that the sixth transistor is turned on to write the data voltage into the first terminal of the storage capacitor and make the two terminals of the storage capacitor keep a voltage difference, and the fourth transistor and the fifth transistor are turned on to form an access, so that the driving transistor is connected to the power supply line, so as to drive the light emitting to emit light.

9. An array substrate comprising the pixel driving circuit according to claim 1.

10. A display apparatus comprising the array substrate according to claim 9.

11. The pixel driving circuit according to claim 2, wherein the light emitting device is an organic light emitting diode, whose anode is connected to the light emitting control unit and cathode is connected to the ground.

12. The pixel driving circuit according to claim 3, wherein the light emitting device is an organic light emitting diode, whose anode is connected to the light emitting control unit and cathode is connected to the ground.

13. The pixel driving circuit according to claim 4, wherein the light emitting device is an organic light emitting diode, whose anode is connected to the light emitting control unit and cathode is connected to the ground.

14. The array substrate according to claim 9, wherein the resetting unit comprises a first transistor, whose gate is connected to the enabling control line, source is connected to the first terminal of the storage capacitor, and drain is connected to a ground; and the first transistor is configured to make the first terminal of the storage capacitor connected to the ground under the control of the enabling control line, so as to set the first terminal of the storage capacitor to a low voltage.

15. The array substrate according to claim 14, wherein the data writing unit comprises: a second transistor and a third transistor, wherein a gate of the second transistor is connected to the first scanning line, a source thereof is connected to the data line, and a drain thereof is connected to a source of the driving transistor; a gate of the third transistor is connected to the first scanning line, a source thereof is connected to a drain of the driving transistor, and a drain thereof is connected to the second terminal of the storage capacitor; and the second transistor and the third transistor are configured to form an access under the control of the first scanning line, so as to write the information including the threshold voltage of the driving transistor and the voltage of the data line into the second terminal of the storage capacitor.

16. The array substrate according to claim 15, wherein the light emitting control unit comprises: a fourth transistor, a fifth transistor and a sixth transistor; a gate of the fourth transistor is connected to the second scanning line, a source thereof is connected to the power supply line, and a drain thereof is connected to the source of the driving transistor; a gate of the fifth transistor is connected to the second scanning line, a source thereof is connected to the drain of the driving transistor, and a drain thereof is connected to the light emitting device; a gate of the sixth transistor is connected to the second scanning line, a source thereof is connected to the data line, and a drain thereof is connected o the first terminal of the storage capacitor; the sixth transistor is configured to write the voltage of the data line into the first terminal of the storage capacitor under the control of the second scanning line and make the two terminals of the storage capacitor keep a voltage difference, and the fourth transistor and the fifth transistor are configured to form an access under the control of the second scanning line, so that the driving transistor is connected to the power supply, so as to drive the light emitting device to emit light.

17. The array substrate according to claim 9, wherein the light emitting device is an organic light emitting diode, whose anode is connected to the light emitting control unit and cathode is connected to the ground.

18. The array substrate according to claim 14, wherein the light emitting device is an organic light emitting diode, whose anode is connected to the light emitting control unit and cathode is connected to the ground.

19. The array substrate according to claim 15, wherein the light emitting device is an organic light emitting diode, whose anode is connected to the light emitting control unit and cathode is connected to the ground.

20. The array substrate according to claim 16, wherein the light emitting device is an organic light emitting diode, whose anode is connected to the light emitting control unit and cathode is connected to the ground.

* * * * *